United States Patent [19]

Swan

[11] 4,166,024

[45] Aug. 28, 1979

[54] PROCESS FOR SUPPRESSION OF HYDROGENOLYSIS AND $C_5$+ LIQUID YIELD LOSS IN A CYCLIC REFORMING UNIT

[75] Inventor: George A. Swan, Baton Rouge, La.

[73] Assignee: Exxon Research & Engineering Co., Florham Park, N.J.

[21] Appl. No.: 923,192

[22] Filed: Jul. 10, 1978

[51] Int. Cl.[2] ..... C10G 35/08

[52] U.S. Cl. ..... 208/65; 208/138; 208/139; 208/140; 252/415

[58] Field of Search ..... 208/65, 138, 139, 140; 252/415

[56] References Cited

U.S. PATENT DOCUMENTS

| | | | |
|---|---|---|---|
| 3,573,199 | 3/1971 | McCoy | 208/65 |
| 3,684,692 | 8/1972 | Keith et al. | 208/65 |
| 3,835,063 | 9/1974 | Davis et al. | 208/140 |
| 3,875,047 | 4/1975 | Dalsom et al. | 208/65 |
| 4,125,454 | 11/1978 | Clem et al. | 208/65 |

*Primary Examiner*—C. Davis

*Attorney, Agent, or Firm*—L. A. Proctor

[57] ABSTRACT

A process for reforming naphtha, with hydrogen, in a cyclic reforming unit which contains a plurality of catalyst-containing on-stream reactors in series, and a catalyst-containing swing reactor manifolded therewith which can be periodically placed in series and substituted for an on-stream reactor while the latter is removed from series for regeneration and reactivation of the catalyst contained therein. In the process, the ability of a catalyst to operate in a hydrogenolysis mode and effect sulfur release can be effectively suppressed after the freshly prepared catalyst has been regenerated, and reactivated several times, generally about five times or more, by the addition thereto of sufficient sulfur to maintain an equilibrium amount of sulfur on the catalyst, preferably a maximum of about 0.01 weight percent sulfur. Preferably, a modified catalyst presulfiding regimen is imposed wherein the amount of sulfur added to a fresh catalyst is progressively, and preferably proportionately reduced from one regeneration, reactivation sequence to the next such that, on and after about the fifth regeneration, and reactivation of the catalyst a maximum of about 0.01 weight percent sulfur is added to the catalyst. In a preferred mode of operation, the catalyst of the lead reactors of the series is not directly sulfided, but indirectly sulfided by sulfur added to, and released by the tail reactor, or reactors. An on-stream water wave displaces sulfur from the sulfided catalyst of the tail reactor, or reactors, as it is returned to service, and a water wave from the catalyst of each reactor redistributes sulfur to undersulfided catalysts of other reactors in the form of hydrogen sulfide released to and carried by the recycle gas.

23 Claims, 1 Drawing Figure

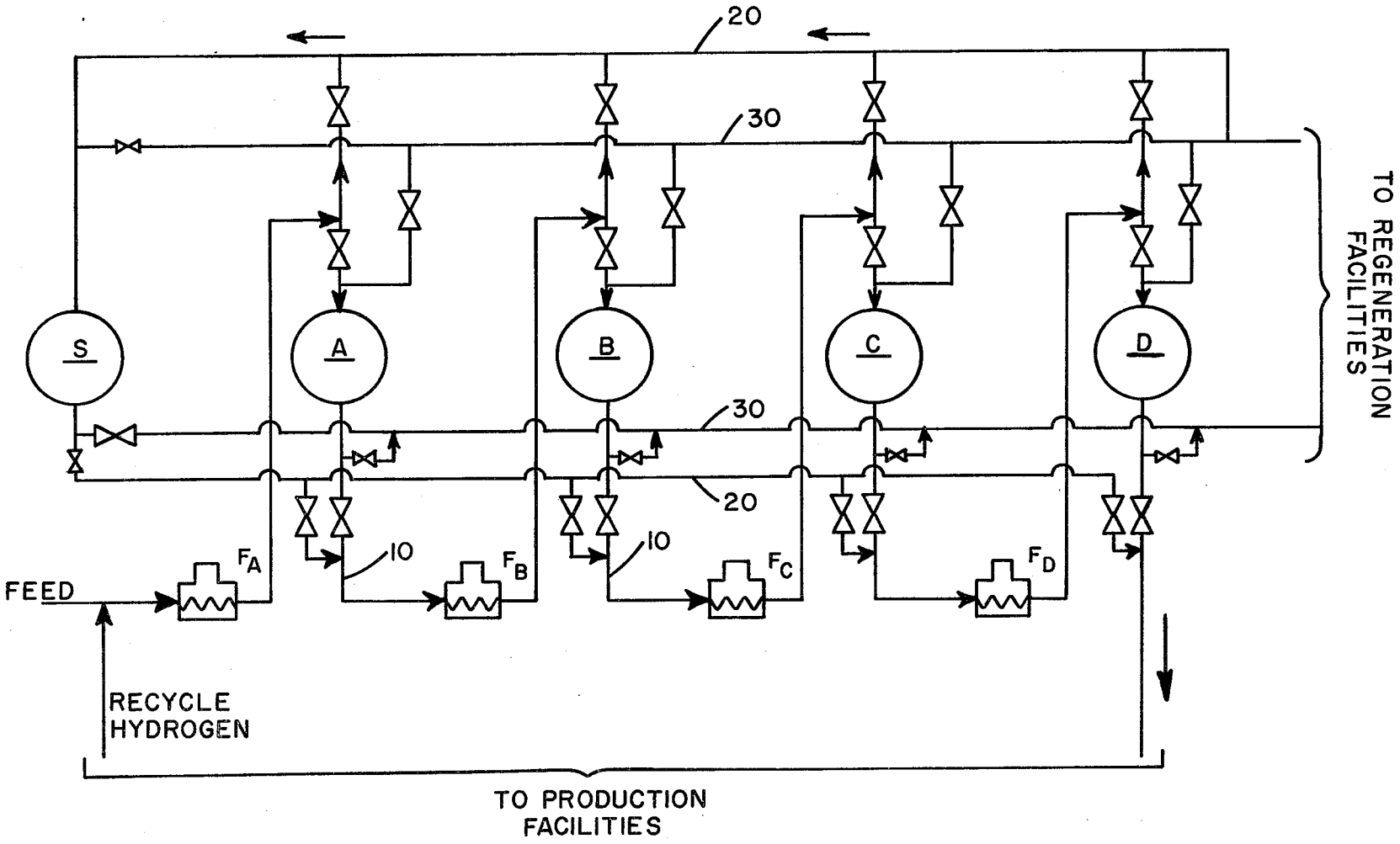
FIGURE

PROCESS FOR SUPPRESSION OF HYDROGENOLYSIS AND $C_5$+ LIQUID YIELD LOSS IN A CYCLIC REFORMING UNIT

Reforming with hydrogen, or hydroforming, is a well established industrial process employed by the petroleum industry for upgrading virgin or cracked naphthas for the production of high octane products. Noble metal, notably platinum type catalysts are currently employed, reforming being defined as the total effect of the molecular changes, or hydrocarbon reactions, produced by dehydrogenation of cyclohexanes and dehydroisomerization of alkylcyclopentanes to yield aromatics; dehydrogenation of paraffins to yield olefins; dehydrocyclization of paraffins and olefins to yield aromatics; isomerization of n-paraffins; isomerization of alkylcycloparaffins to yield cyclohexanes; isomerization of substituted aromatics; and hydrocracking of paraffins to produce gas and coke, the latter being deposited on the catalyst.

These several reactions are both endothermic and exothermic, the former predominating, particularly in the early stages of reforming with the latter predominating in the latter stages of reforming. In view thereof, it has become the practice to employ a plurality of adiabatic fixed-bed reactors in series with provision for interstage heating of the feed to each of the several reactors. Two major types of reforming are generally practiced in the multi-reactor units, and in all processes the catalyst must be periodically regenerated by burning off the coke in the initial part of the catalyst reactivation sequence; since coke deposition gradually deactivates the catalyst. In a semi-regenerative process, a process of the first type, the entire unit is operated by gradually and progressively increasing the temperature to maintain the activity of the catalyst caused by the coke deposition, until finally the entire unit is shut down for regeneration, and reactivation, of the catalyst. In the second, or cyclic type of process, the reactors are individually isolated, or in effect swung out of line by various piping arrangements, the catalyst is regenerated to remove the coke deposits, and then reactivated while the other reactors of the series remain on stream. A "swing reactor" temporarily replaces a reactor which is removed from the series for regeneration and reactivation of the catalyst, and is then put back in series. In such processes hydrogen is produced in net yield, the product being separated into a $C_5$+ liquid product, e.g., a $C_5$/430° F. product, and a hydrogen rich gas a portion of which is recycled to the several reactors of the process unit.

In a cyclic reforming unit, individual reactors of the multi-reactor unit can be isolated, the catalyst regenerated, and reactivated, and the reactor placed back on stream without significantly affecting unit feed rate or octane quality. By adjusting the regeneration frequency, the unit can be economically designed for the minimum loading of hydrogenation-dehydrogenation metal, or metals components on the catalyst while maintaining an optimum yield of $C_5$+ reformate at given conditions.

Essentially all petroleum naphtha feeds contain sulfur, a well known catalyst poison which can gradually accumulate upon and poison the catalyst. Most of the sulfur, because of this adverse effect, is generally removed from feed naphthas, e.g., by hydrofining or by contact with nickel or cobalt oxide guard chambers, or both. In use of the more recently developed multi-metallic platinum catalysts wherein an additional metal, or metals hydrogenation-dehydrogenation component is added as a promoter to the platinum, it has become essential to reduce the feed sulfur to only a few parts, per million parts by weight of feed (ppm). For example, in the use of platinum-rhenium catalysts it is generally necessary to reduce the sulfur concentration of the feed well below about 10 ppm, and preferably well below about 2 ppm, to avoid excessive loss of catalyst activity and $C_5$+ liquid yield. The role of sulfur on the catalyst presents somewhat of an anomaly because the presence of sulfur in the feed can adversely affect the activity of the catalyst and reduce liquid yield; and yet, sulfiding of the multi-metallic catalyst species, which is a part of the catalyst reactivation procedure, has been found essential to suppress excessive hydrogenolysis which is particularly manifest when a reactor is first put on stream after regeneration and reactivation of the catalyst. Excessive hydrogenolysis caused by use of these highly active catalysts can not only produce acute losses in $C_5$+ liquid yield through increased gas production, but the severe exotherms which accompany operation in a hydrogenolysis mode can seriously damage the catalyst, reactor, and auxiliary equipment.

In cyclic reforming, it has been found that when a reactor containing highly active rhenium promoted platinum catalysts is reinserted in the multiple reactor series of the unit, albeit it contains regenerated, reactivated, sulfided catalyst, there occurs an initial upset period when the catalyst activity and $C_5$+ liquid yield of the unit is reduced. It has been observed that this effect is first noted in the reactor immediately downstream of the swing reactor which when first put on-stream contains a freshly sulfided catalyst. A quantity of sulfur is released when the freshly sulfided catalyst is contacted with the feed, the sulfur wave travelling downstream from one reactor to the next of the sequence. Concurrent with the sulfur wave there results a loss in $C_5$+ liquid yield which, like a wave, also progresses in seratim from one reactor of the series to the next until finally the $C_5$+ liquid yield loss is observed throughout the unit. Over a sufficiently long period after the initial decline in $C_5$+ liquid yield loss, the $C_5$+ liquid yield in the several reactors of the unit, and consequently the overall performance of the unit, gradually improves, though often the improvement is not sufficient to return each of the reactors of the unit, or unit as a whole, to its original higher performance level.

The effect of this phenomenon is that, in the overall operation, the catalyst contained in the several reactors briefly becomes less active, and a transient, but profound $C_5$+ liquid yield loss is observed.

It is, accordingly, the primary object of this invention to provide a new and improved process which will obviate these and other disadvantages of the present start-up procedures for cyclic reforming units, particularly those employing highly active promoted noble metal containing catalysts.

A specific object is to provide a new and novel operating procedure for cyclic reforming units, notably one which will effectively suppress sulfur release and the normally expected initial period of $C_5$+ liquid yield decline which occurs with platinum catalysts to which is added a hydrogenation-dehydrogenation component, or components, particularly rhenium, which increases the tendency of the catalyst to operate in the hydrogenolysis mode.

These objects and others are achieved in accordance with the present invention which comprises a new and improved mode of operating a cyclic reforming unit wherein in the sequence of regeneration and reactivation of the catalyst of any given reactor, the ability of a catalyst to operate in a hydrogenolysis mode and effect sulfur release can be effectively suppressed after the freshly prepared catalyst has been regenerated, and reactivated several times, preferably about five times or more, by the addition thereto of sufficient sulfur to maintain an equilibrium amount of sulfur on the catalyst, as hereinafter defined, preferably by the addition thereto of a maximum of about 0.01 percent sulfur, more preferably from about 0.001 percent to about 0.005 percent sulfur, based on the total weight of the catalyst (dry basis). This mode of operation differs profoundly from a prior art operation wherein from about 0.05 percent to about 0.10 percent sulfur, based on the weight of the catalyst, is added to a catalyst to suppress hydrogenolysis and wherein, when a reactor containing such catalyst is initially put on stream a release of sulfur as hydrogen sulfide in concentration ranging from about 10 to about 20 parts per million parts based on volume (vppm), is released in the recycle gas to poison catalyst dehydrogenation sites, thereby causing excessive cracking and lowered $C_5+$ liquid yields.

This invention is based on the recognition that a water wave immediately follows a sulfur wave when a reactor containing a freshly sulfided catalyst is put on-stream, and that a water wave, on contacting a freshly sulfided catalyst, causes release of sulfur from the catalyst. It is believed that, initially, the sulfur associates itself with the active sites of a catalyst, but thereafter when the catalyst is contacted by water, the water and sulfur moieties compete with each other for association with the active sites of the catalyst. Concurrent with such consideration, it has also been found, quite surprisingly, that residual sulfur remains on the catalyst even after catalyst regeneration, and reactivation, despite the high temperature burn to which the catalyst is subjected to remove coke deposits. This suggests an unusually high affinity of sulfur for catalyst sites; albeit sulfur is so readily displaced from a freshly regenerated, reactivated catalyst by water. As a consequence, it has been found that far smaller amounts of sulfur than are conventional can be beneficially employed in overall catalyst presulfiding operations, particularly in sulfiding catalysts which have previously been regenerated, and reactivated a number of times. Pre-sulfided catalysts which have been previously regenerated, and reactivated require far less sulfur to maintain an effective sulfide level, and apparently after several regeneration/reactivation sequences of treatment the sulfide level reaches an equilibrium level of from about 0.03 to about 0.04 wt. % sulfur on the catalyst. Thereafter, only minimal sulfur need be added to the system, if any, to maintain the effective sulfide level on the catalysts of the several reactors; and, the added sulfur can be effectively distributed from the catalyst of any given reactor to the catalysts of other reactors for maintenance purposes by pre-sulfiding only the catalyst of a selected reactor, or reactors, because sulfur will be carried throughout the reactor system by recycle hydrogen, sulfur will be adsorbed by the catalysts if they are undersulfided, and water waves will remove sulfur from oversulfided catalyst and redistribute sulfur to undersulfided catalysts.

A feature of the invention then also resides in the discovery that even when a reactor containing a freshly prepared catalyst is put on stream benefits can also be derived by use of a modified catalyst presulfiding regimen wherein the amount of sulfur added to the catalyst is progressively, and preferably proportionately reduced from one regeneration, reactivation sequence to the next until such time that an equilibrium amount of residual sulfur has been retained by the catalyst. Preferably on and after about the fifth regeneration, and reactivation sequence, a maximum of about 0.01 percent sulfur, based on the total weight of the catalyst (dry basis), is added to the catalyst. In a preferred sequence of operation, a maximum of from about 0.05 percent to about 0.10 percent sulfur, based on the total weight of the catalyst (dry basis), is added ab initio to the fresh catalyst, the maximum amount of sulfur added to the catalyst being reduced about twenty percent to about forty percent with each regeneration, and reactivation of the catalyst. Thus, e.g., if 0.05 weight percent sulfur is put on the fresh catalyst, about 0.04 weight percent is put on the catalyst after the first regeneration, and reactivation of the catalyst; about 0.03 weight percent is put on the catalyst after the second regeneration and reactivation of the catalyst; about 0.025 weight percent is put on the catalyst after the third regeneration and reactivation of the catalyst; about 0.015 weight percent is put on the catalyst after the fourth regeneration and reactivation of the catalyst; and about 0.01 weight percent is put on the catalyst after the fifth regeneration, and reactivation of the catalyst. Similarly, if 0.10 percent weight percent sulfur is put on the fresh catalyst; about 0.08 weight percent sulfur is put on the catalyst after the first regeneration, and reactivation of the catalyst; about 0.06 weight percent sulfur is put on the catalyst after the second regeneration, and reactivation of the catalyst; about 0.04 weight percent sulfur is put on the catalyst after the third regeneration, and reactivation of the catalyst; about 0.02 weight put on the catalyst after the fourth regeneration, and reactivation of the catalyst; and about 0.01 weight put on the catalyst after the fifth regeneration, and reactivation of the catalyst.

In a more preferred operation, a minimum amount of sulfur is released into the recycle gas of the cyclic system, and consequently less sulfur is available for poisoning of the dehydrogenation sites of the catalyst, such that substantially optimal $C_5+$ liquid yield is achieved with smoother operation, and better catalyst utilization following reactor swings. In this embodiment, after about the fifth sequence of regeneration, and reactivation of a catalyst only the catalyst is the tail reactor, or reactors (i.e., the reactor, or reactors, in the rearward part of the series) are sulfided, while the catalyst in the lead reactor, or reactors (i.e., the reactor, or reactors in the forward part of the series), are left unsulfided. For example, in a reactor series which includes Reactors A, B, C and D, and a swing Reactor S, after about the fifth sequence of regeneration, and reactivation of the catalysts only the catalyst of Reactors B, C and D, or preferably only the catalysts of Reactors C and D are sulfided, or more preferably only the catalyst of Reactor D is sulfided, while the catalyst of Reactor A, or preferably the catalysts of Reactors A and B, or more preferably the catalysts of Reactors A, B and C, are left unsulfided. If the catalyst of swing Reactor S is regenerated, reactivated and returned to service and moved into the first (position A), or preferably the first or second position of the series (position A or B), or more preferably the first, second, or third position of the series (position A, B or C) the catalyst, after about five regeneration/reactivation sequences of treatment, is not presulfided. On return of a reactor to the A, the A or B, or the A, B or C position of the series, however, there is no sulfur release when the reactor is initially put on stream since the catalyst is undersulfided. However, a water wave from the catalyst of each reactor suscessively returned to service passes through the downstream reactors and displaces sulfur from the catalysts of these reactors, the emitted sulfur emerging as hydrogen sulfide in the recycle gas which is recycled to the lead reactor, or reactors, to sulfide the unsulfided, or undersulfided catalyst. As the unsulfided, or undersulfided catalyst is sulfided by adsorption onto the catalyst, the hydrogen sulfide concentration in the recycle gas is decreased. The net effect is that marginally excess sulfur on the catalyst in the tail reactor, or reactors, is redistributed to the lead reactor, or reactors, and the hydrogen sulfide in the recycle gas rapidly lines out, e.g., within two to three hours from the time the reactor containing the unsulfided, or undersulfided catalyst is put on stream, to a base level of about 1 vppm sulfur in the recycle gas. This is sharply contrasted with conventional presulfiding wherein the catalysts of all of the reactors are sulfided to levels ranging from 0.05 weight percent to 0.10 weight percent, and wherein a reactor swing of approximately 24 hours duration is produced before line out occurs, this resulting in a significantly greater $C_5+$ liquid yield loss, principally due to $C_3/C_4$ cracking.

It is essential to maintain a dry system for sulfur cannot be effectively adsorbed by a wet catalyst. This means, in effect, that the recycle gas must be kept dry. In all embodiments, the off gas from the last reactor of the series, predominantly hydrogen containing moisture and hydrogen sulfide, is passed through a drier wherein essentially all or a major portion of the moisture is removed, suitably by contact with an adsorbent, after which time the gas is recycled to the process. Preferably, the moisture level of the recycle gas is maintained below about 50 parts, more preferably below about 20 parts, per million parts of hydrogen. Suitably also, some of the hydrogen sulfide can be removed from the recycle gas should its concentration become excessive. Generally, the hydrogen sulfide level in the recycle gas is maintained below about 10 parts, or more preferably below about 5 parts, per million parts of hydrogen.

Sulfur can also enter the system through the hydrocarbon feed, and consequently the feed sulfur level is also maintained at very low level. On the other hand, where the sulfur level of the catalyst of the several reactors of a unit have already substantially equilibrated, or reached an equilibrium sulfur level, a major portion of the sulfur required to maintain an equilibrium amount thereof on the catalyst of the several reactors can be added to the feed.

These features and others will be better understood by reference to the following more detail description of the invention, and to the drawing to which reference is made.

In the drawing:

The FIGURE depicts, by means of a simplified flow diagram, a preferred cyclic reforming unit inclusive of multiple on-stream reactors, and an alternate or swing reactor inclusive of manifolds for use with catalyst regeneration and reactivation equipment (not shown).

Referring to the FIGURE, generally, there is described a cyclic unit comprised of a multi-reactor system, inclusive of on-stream Reactors A, B, C, D and a swing Reactor S, and a manifold useful with a facility for periodic regeneration and reactivation of the catalyst of any given reactor, swing Reactor S being manifolded to Reactors A, B, C, D so that it can serve as a substitute reactor for purposes of regeneration and reactivation of the catalyst of a reactor taken off-stream. The several reactors of the series A, B, C, D, are arranged so that while one reactor is off-stream for regeneration and reactivation of the catalyst, the swing Reactor S can replace it and provision is also made for regeneration and reactivation of the catalyst of the swing reactor.

In particular, the on-stream Reactors A, B, C, D, each of which is provided with a separate furnace or heater $F_A$, or reheater $F_B$, $F_C$, $F_D$, respectively, are connected in series via an arrangement of connecting process piping and valves so that feed can be passed in seratim through $F_AA$, $F_BB$, $F_CC$, $F_DD$, respectively; or generally similar grouping wherein any of Reactors A, B, C, D are replaced by Reactor S. This arrangement of piping and valves is designated by the numeral 10. Any one of the on-stream Reactors A, B, C, D, respectively, can be substituted by swing Reactor S as when the catalyst of any one of the former requires regeneration and reactivation. This is accomplished in "paralleling" the swing reactor with the reactor to be removed from the circuit for regeneration by opening the valves on each side of a given reactor which connect to the upper and lower lines of swing header 20, and then closing off the valves in line 10 on both side of said reactor so that fluid enters and exits from said swing Reactor S. Regeneration facilities, not shown, are manifolded to each of the several Reactors A, B, C, D, S through a parallel circuit of connecting piping and valves which form the upper and lower lines of regeneration header 30, and any one of the several reactors can be individually isolated from the other reactors of the unit and the catalyst thereof regenerated and reactivated.

In conventional practice the reactor regeneration sequence is practiced in the order which will optimize the efficiency of the catalyst based on a consideration of the amount of coke deposited on the catalyst of the different reactors during the operation. Coke deposits much more rapidly on the catalyst of Reactors C, D and S than on the catalyst of Reactors A and B and, accordingly, the catalysts of the former are regenerated and reactivated at greater frequency than the latter. The reactor regeneration sequence is characteristically in the order ACDS/BCDS, i.e., Reactors A, C, D, B, etc., respectively, are substituted in order by another reactor, typically swing Reactor S, and the catalyst thereof regenerated and reactivated while the other four reactors are left on-stream. In the practice of the present invention, virtually any reactor regeneration sequence can be followed.

With reference to the FIGURE, for purposes of illustrating a regeneration, reactivation sequence, it is assumed that all of Reactors A, B, C, D and S were charged ab initio with fresh catalyst presulfided to deposit 0.05 weight percent sulfur on the catalyst, and Reactors A, B, C, D then put on-stream. The catalyst of each of the several Reactors A, B, C, D are then each removed from the unit as the catalyst is deactivated, the catalyst of each subsequently regenerated, and reactivated in conventional sequence, supra. With each progressive presulfiding the level of sulfur deposited on the catalyst of each of Reactors A, B, C, D and S is progressively, and proportionately reduced until at the end of the fifth catalyst regeneration, and reactivation, the catalyst is found to equilibrate at a level of from 0.03 to 0.04 weight percent sulfur. Thereafter, only the catalysts of Reactors D and S are presulfided, and the catalyst of Reactor S is only presulfided when employed as a substitute for Reactor D, these reactors acting, on their suscessive return to service, to restore the level of sulfur on the undersulfided catalyst of all of the reactors to about 0.03 to 0.04 weight percent.

In conducting the reforming operations, substantially all or a major portion of the moisture is scrubbed, or adsorbed from the hydrogen recycle gas which is returned to the unit to maintain a dry system. The recycle gas of the system should be dried sufficiently such that it contains a maximum of about 50 parts, preferably 20 parts, per million parts of water.

The invention, and its principle of operation, will be more fully understood by reference to the following examples, and comparative data which characterized a preferred mode of operation

EXAMPLES

In an operating run, Reactors A, B, C, D and S were each charged with a commercially supplied catalyst which contained platinum and rhenium well dispersed upon the surface of a gamma alumina support. The catalyst was dried, calcined, and then sulfided by contact with an admixture of n-butyl mercaptan in hydrogen, the gas having been injected into the reactor to provide a catalyst (dry basis) of the following weight composition, to wit:

| Catalyst | |
|---|---|
| Platinum | 0.3 wt. % |
| Rhenium | 0.3 wt. % |
| Chloride | 0.9 wt. % |
| Sulfur | 0.05-0.1 wt. % |
| Alumina | Balance wt. % |

A reforming run was then initiated, Reactors A, B, C and D having been placed on-stream with Reactor S in stand-by position, by adjusting the hydrogen and feed rates to the reactors, the feed being characterized as Light Arabian/West Texas Virgin naphtha blend which had, as shown in Table I, the following inspections:

Table I

| ASTM Distillation, °F. | |
|---|---|
| Initial | 185 |
| 10 | 217 |
| 20 | 224 |
| 30 | 235 |
| 40 | 248 |
| 50 | 258 |
| 60 | 274 |
| 70 | 287 |
| 80 | 303 |
| 90 | 321 |
| Final B.P. | 391 |
| Octane No., RON Clear | 40-50 (estimated) |
| Gravity, °API | 57.5 |
| Sulfur, Wt. ppm | 0.5 wppm |
| Analysis, Vol. Percent | |
| Paraffins | 55.6 |
| Naphthenes | 34.1 |
| Aromatics | 10.3 |

The temperature and pressure of the reactors were then adjusted to the operating conditions required to produce a 102 RONC octane $C_5+$ liquid product, and the run was continued at generally optimum reforming conditions by adjustment of these and other major process variables to those given below:

| Major Operating Variables | Process Conditions |
|---|---|
| Pressure, Psig | 175 |
| Average Reactor Temp., °F. | 920-940 |
| Recycle Gas Rate, SCF/B | 3000-3500 |
| Feed Rate, W/W/Hr. | 0.9-1.4 |

The run was continued until such time that sufficient coke had deposited on the catalyst of a reactor that regeneration, and reactivation was required. Each reactor of the series was periodically replaced and the catalyst thereof regenerated, and reactivated a multiple number of times, as required; Reactors C and D, and Reactor S when placed in the position of Reactors C and D, requiring regeneration and reactivation about twice as often as Reactors A and B. The regeneration in each instance was accomplished by burning the coke from the coked catalyst, initially by burning at 950° F. by the addition of a gas which contained 0.6 mole percent oxygen; and thereafter the temperature was raised to 980° F. while the oxygen concentration in the gas was increased to 6 mole percent. Reactivation in each instance was conducted by the steps of: (a) redispersing the agglomerated metals by contact of the catalyst with a gaseous admixture containing sufficient carbon tetrachloride to decompose in situ and deposit 0.1 wt. % chloride on the catalyst; (b) continuing to add a gaseous mixture containing 6% oxygen for a period of 2 to 4 hours while maintaining a temperature of 950° F.; (c) purging with nitrogen to remove essentially all traces of oxygen from the reactor; and (d) reducing the metals of the catalyst of contact with a hydrogen-containing gas at 850° F.

The amount of sulfur directly added to each reactor subsequent to each regeneration/reactivation sequence is given in Table II. Initially, in each instance after a regeneration/reactivation sequence, the activation of the catalyst was completed by sulfiding the catalyst of all of Reactors A, B, C, D and S by direct contact with a gaseous admixture of n-butyl mercaptan in hydrogen, sufficient to deposit a target amount of sulfur on the catalyst. After initial sulfiding of the catalyst, the amount of sulfur added to the catalyst of each reactor was progressively reduced, and after the fifth regeneration/reactivation sequence, no additional sulfur was directly added to the catalyst of Reactors A and B. The catalyst of Reactors A and B were thereafter sulfided in situ by contact with the hydrogen sulfide containing recycle hydrogen, previously passed through a recycle drier to remove essentially all of the water; and, no further regeneration and reactivation of the catalyst was necessary. The amount of sulfur added to the catalysts of Reactors C, D and S was progressively reduced through the ninth regeneration/reactivation sequence and thereafter no sulfur was directly added to Reactor C. The catalyst of Reactor C, like that of Reactors A and B were thereafter sulfided only by contact with the hydrogen sulfide containing recycle gas stream, and no further regeneration and reactivation of the catalyst was necessary.

Table II

| No. of Reactivations | Direct Sulfur (Wt. % on Catalyst) Added to Catalyst of Reactor After Reactivation | | | | |
|---|---|---|---|---|---|
| | A | B | C | D | S |
| 1 | — | 0.05 | 0.047 | 0.05 | 0.039 |
| 2 | — | — | — | — | — |
| 3 | 0.075 | 0.029 | — | — | — |
| 4 | 0.023 | 0.027 | 0.031 | 0.033 | 0.039 |
| 5 | 0.011 | 0.013 | 0.027 | 0.029 | 0.029 |
| 6 | 0 | 0 | 0.024 | 0.027 | 0.031 |
| 7 | 0 | 0 | 0.02 | 0.022 | 0.024 |
| 8 | 0 | 0 | 0.013 | 0.015 | 0.015 |
| 9 | 0 | 0 | 0.007 | 0.009 | 0.011 |
| 10 | 0 | 0 | 0 | 0.002 | 0.004 |

It was found that when a reactor is returned to service after regeneration and reactivation of the catayst, some sulfur remains on the catalyst, even though the catalyst is not directly sulfided. An in situ water wave from the freshly regenerated/reactivated catalyst of an upstream reactor contacting a platinum-rhenium catalyst which contains more than about 0.03 to 0.04 wt. % sulfur will redistribute the excess sulfur to an undersulfided catalyst of a downstream reactor, i.e., one which contains a platinum-rhenium catalyst having less than about 0.03 to 0.04 wt. % sulfur. In such system therefore, excess sulfur from an oversulfided catalyst will be distributed to the undersulfided catalyst of a downstream reactor, or recycled with dry hydrogen and redistributed to the undersulfided catalyst of an upstream reactor. This means, in effect, that the addition of sulfur to the system in any amount more than that required to provide an equilibrium level on the catalyst results in decreased catalyst activity and loss of $C_5+$ liquid yield.

The advantages of operating the process at conditions required to maintain as close as possible to an equilibrium level of sulfur on the catalyst, and low concentration of hydrogen sulfide in the recycle gas, can be conveniently shown by comparison of the hydrogen sulfide contained in the recycle, the activity of the catalyst and $C_5+$ liquid yield obtained under the different conditions of operation. Consequently, to show such comparison, reference is again made to the tabulation given in Table II, and to the data given in Table III which presents a comparison of the average amount of hydrogen sulfide contained in the recycle gas (as measured on the exit side of the last reactor of the series, and upstream of the recycle gas drier), the average catalytic activity and the total $C_5+$ liquid yield produced after a final direct sulfiding of the catalysts in Reactors A and B subsequent to the fifth regeneration/reactivation sequence (which added 0.011 wt. % and 0.013 wt. % sulfur, respectively, on the catalyst) and the ninth-sulfiding of the catalysts of Reactors C, D and S following the ninth regeneration/reactivation sequence (which added 0.007 wt. %, 0.009 wt. % and 0.011 wt. % sulfur, respectively, on the catalyst) vis-a-vis the following run made after directly sulfiding only the catalysts of Reactors D and S, without direct sulfiding of the catalysts of any of Reactors A, B and C.

Table III

| Reforming Operation Subsequent to Regeneration/ Reactivation Sequence No. | Performance Comparisons | | |
|---|---|---|---|
| | Avg. $H_2S$, vppm in Recycle Gas | Catalyst Activity | $C_5+$ Yield, LV% |
| 5, Reactors A and B; 9, Reactors C, D and S | 3 | 36 | 72.8 |
| 5, Reactors A and B; 9, Reactor C; and 10, Reactors D and S | 0.5 | 46 | 74.2 |

In swinging reactors containing undersulfided catalyst into position, it was found that the sulfur concentration in the recycle gas actually dropped, and after several hours began to line out as the sulfur level on the catalyst equilibrated. When, e.g., Reactor C was returned to service without direct sulfiding of the catalyst of this reactor subsequent to regeneration and reactivation of the catalyst, a water wave from this reactor caused displacement of some sulfur from the D reactor as hydrogen sulfide, which was recycled with hydrogen to the upstream reactors of the unit, and redistributed throughout the system.

As clearly shown, this process provides a means for eliminating excess sulfur by using in situ water to redistribute minimal sulfur on catalyst, instead of directly presulfiding the catalyst of each reactor following a regeneration/reactivation sequence.

It is apparent that the present invention is subject to various modifications and changes without departing the spirit and scope thereof.

The present invention finds its greatest utility in cyclic reforming processes whrein the new "bimetallic" or multi-metallic catalysts are employed, notably Group VIII platinum group, or noble metals (ruthenium, rhodium, palladium, osmium, iridium and platinum), e.g., platinum-rhenium, platinum-rhenium-iridium, palladium-rhenium, platinum-palladium-rhenium, etc. Fresh, or reactivated catalyst of this type are particularly hypersensitive. Exotherms or heat fronts can be produced which pass through a catalyst bed at startup, i.e., when new or freshly regenerated catalyst is initially contacted with hydrocarbons at reforming temperatures. The temperature excursions or heat fronts are attributed to the hyperactivity of the catalyst which causes excessive hydrocracking of the hydrocarbons or hydrogenolysis, sometimes referred to as "runaway hydrocracking." These temperature excursions or heat fronts are undesirable because the resultant temperature often results in damage to the catalyst, or causes excessive coke laydown on the catalyst with consequent catalyst deactivation and, if uncontrolled, may even lead to damage to the reactor and reactor internals.

Other catalysts suitable for the practice of this invention contain a hydrogenation-dehydrogenation component constituted of a platinum group metal, or admixtures of these and/or one or more additional non-platinum group metallic components such as germanium, gallium, tin, rhenium, tungsten, and the like. A preferred type of catalyst contains the hydrogenation-dehydrogenation component in concentration ranging from about 0.01 to about 5 wt. %, and preferably from about 0.2 to about 1.0 wt. %, based on the total catalyst composition. In addition, such catalysts also usually contain an acid component, preferably halogen, particularly chlorine or fluorine, in concentration ranging from about 0.1 to about 5 wt. %, and preferably from about 0.3 to about 1.0 wt. %. The hydrogenation-dehydrogenation components are composited with an inorganic oxide support, such as silica, silica-alumina, magnesia, thoria, zirconia, or the like, and preferably alumina.

Methods of regeneration, and reactivation of these catalysts are known and per se form no part of the present invention. Conventionally, an isolated reactor which contains a bed of catalyst, the latter having reached on objectionable degree of deactivation due to coke deposition thereon, is first purged of hydrocarbon vapors with a nonreactive or inert gas, e.g., helium, nitrogen, or flue gas. The coke or carbonaceous deposits are then burned from the catalyst by contact with an oxygen-containing gas at controlled temperature below the sintering point of the catalyst, generally below about 1300° F., and preferably below about 1200° F. The temperature of the burn is controlled by controlling the oxygen concentration and inlet gas temperature, this taking into consideration, of course, the amount of coke to be burned and the time desired in order to complete the burn. Typically, the catalyst is treated with a gas having an oxygen partial pressure of at least about 0.1 psi (pounds per square inch), and preferably in the range of about 0.3 psi to about 2.0 psi to provide a temperature ranging from 575° F. to about 1000° F., at static or dynamic conditions, preferably the latter, for a time sufficient to remove the coke deposits. Coke burn-off can be accomplished by first introducing only enough oxygen to initiate the burn while maintaining a temperature on the low side of this range, and gradually increasing the temperature as the flame front is advanced by additional oxygen injection until the temperature has reached optimum. Most of the coke can be readily removed in this way.

Typically in reactivating multimetallic catalysts, sequential halogenation and hydrogen reduction treatments are required to reactivate the reforming catalysts to their original state of activity, or activity approaching that of fresh catalyst after coke or carbonaceous deposits have been removed from the catalyst. Suitably, the coke is burned from the catalyst, initially by contact thereof with an admixture of air and about 0.75 wt. percent oxygen at temperatures ranging to about 750° F., and thereafter the oxygen is increased within the mixture to about 6 wt. percent and the temperature gradually elevated to about 950° F.

The agglomerated metals of the catalyst are redispersed and the catalyst reactivated by contact of the catalyst with halogen, suitably a halogen gas or a substance which will decompose in situ to generate halogen. Various procedures are available dependent to a large extent on the nature of the catalyst employed. Typically, e.g., in the reactivation of a platinum-rhenium catalyst, the halogenation step is carried out by injecting halogen, e.g., chlorine, bromine, fluorine or iodine, or a halogen component which will decompose in situ and liberate halogen, e.g., carbon tetrachloride, in the desired quantities, into the reaction zone. The gas is generally introduced as halogen, or halogen-containing gaseous mixture, into the reforming zone and into contact with the catalyst at temperature ranging from about 550° F. to about 1150° F., and preferably from about 700° F. to about 1000° F. The introduction may be continued up to the point of halogen breakthrough, or point in time when halogen is emitted from the bed downstream of the location of entry where the halogen gas is introduced. The concentration of halogen is not critical, and can range, e.g., from a few parts per million (ppm) to essentially pure halogen gas. Suitably, the halogen, e.g., chlorine, is introduced in a gaseous mixture wherein the halogen is contained in concentration ranging from about 0.01 mole percent to about 10 mole percent, and preferably from about 0.1 mole percent to about 3 mole percent.

After redispersing the metals with the halogen treatment, the catalyst can then be rejuvenated by soaking in an admixture of air which contains about 6 wt. percent oxygen, at temperatures ranging from about 850° F. to about 950° F.

Oxygen is then purged from the reaction zone by introduction of a nonreactive or inert gas, e.g., nitrogen, helium or flue gas, to eliminate the hazard of a chance explosive combination of hydrogen and oxygen. A reducing gas, preferably hydrogen or a hydrogen-containing gas generated in situ or ex situ, is then introduced into the reaction zone and contacted with the catalyst at temperatures ranging from about 400° F. to about 1100° F., and preferably from about 650° F. to about 950° F., to effect reduction of the metal hydrogenation-dehydrogenation components, contained on the catalysts. Pressures are not critical, but typically range between about 5 psig to about 300 psig. Suitably, the gas employed comprises from about 0.5 to about 50 percent hydrogen, with the balance of the gas being substantially nonreactive or inert. Pure, or essentially pure, hydrogen is, of course, suitable but is quite expensive and therefore need not be used. The concentration of the hydrogen in the treating gas and the necessary duration of such treatment, and temperature of treatment, are interrelated, but generally the time of treating the catalyst with a gaseous mixture such as described ranges from about 0.1 hour to about 48 hours, and preferably from about 0.5 hour to about 24 hours, at the more preferred temperatures.

The catalyst of a reactor may be presulfided, prior to return of the reactor to service. Suitably a carrier gas, e.g., nitrogen, hydrogen, or admixture thereof, containing from about 500 to about 2000 ppm of hydrogen sulfide, or compound, e.g., a mercaptan, which will decompose in situ to form hydrogen sulfide, at from about 700° F. to about 950° F., is contacted with the catalyst for a time sufficient to incorporate the desired amount of sulfur upon the catalyst.

Having described the invention what is claimed is:

1. In a process for reforming, with hydrogen, a naphtha in a cyclic reforming unit which contains a plurality of catalyst-containing on-stream reactors connected in series, and a catalyst-containing swing reactor which, due to an arrangement of process piping and valves comprising headers, can be substituted for any one of the on-stream reactors while the latter is off-stream for regeneration and reactivation of the catalyst, the hydrogen and naphtha feed flowing from one reactor of the series to another to contact the catalyst contained therein at reforming conditions, the improvement comprising adding a maximum of about 0.01 percent sulfur, based on the total weight of the catalyst, to the catalyst of a reactor after the freshly prepared catalyst has been regenerated and reactivated about five times, or more.

2. The process of claim 1 wherein after about the fifth regeneration/reactivation sequence the catalysts of the lead reactors of the series are no longer directly sulfided, but only the catalysts of the tail reactors are directly sulfided.

3. The process of claim 1 wherein the first reactor of the series is left unsulfided after about the fifth regeneration/reactivation sequence, and other reactors of the series are directly sulfided.

4. The process of claim 1 wherein the unit contains at least three on-stream reactors in series, the catalysts of the first two reactors of the series are left unsulfided after about the fifth regeneration/reactivation sequence, and other reactors of the series are directly sulfided.

5. The process of claim 1 wherein the unit contains at least four on-stream reactors in series, the first three reactors of the series are left unsulfided after about the fifth regeneration/reactivation sequence, and other reactors of the series are directly sulfided.

6. The process of claim 1 wherein the unit contains at least three on-stream reactors in series, at least the first three reactors of the series are left unsulfided after about the fifth regeneration/reactivation sequence, the last reactor of the series is substituted by a swing reactor, and only the catalyst of the swing reactor is directly sulfided prior to the substitution.

7. The process of claim 1 wherein the hydrogen gas from the last reactor of the series is dried to remove moisture, and recycle hydrogen containing less than about 50 parts of water, per million parts of hydrogen, is circulated within the unit.

8. The process of claim 1 wherein a series of four on stream reactors are identified, for convenience, as A, B, C, D, respectively, and the swing reactor is identified, for convenience as S, the improvement wherein after about the fifth regeneration/reactivation sequence the catalysts of the lead reactors are no longer directly sulfided, but only the tail reactors are directly sulfided.

9. The process of claim 8 wherein Reactor A is left unsulfided after about the fifth regeneration/reactivation sequence, and Reactors B, C and D, and Reactor S when substituted for any of Reactors B, C and D, are directly sulfided.

10. The process of claim 8 wherein the catalysts of Reactors A and B are left unsulfided after about the fifth regeneration/reactivation sequence, and Reactors C and D, and Reactor S when substituted for Reactors C and D, are directly sulfided.

11. The process of claim 8 wherein Reactors A, B and C are left unsulfided after about the fifth regeneration/-reactivation sequence, and only Reactor D, and Reactor S when substituted for Reactor D, is sulfided.

12. The process of claim 8 wherein Reactors A, B and C are left unsulfided after about the fifth regeneration/-reactivation sequence, Reactor D is substituted by swing Reactor S, and only the catalyst of Reactor S is directly sulfided.

13. The process of claim 8 wherein the hydrogen gas from the last reactor of the series is dried to remove moisture, and recycle hydrogen containing less than about 50 parts of water, per million parts of hydrogen, is circulated within the unit.

14. The process of claim 1 wherein sulfur is added to the catalysts during about the first five catalyst regeneration/reactivation sequences, the sulfur added to the catalyst being progressively reduced between the first catalyst regeneration/reactivation sequence and about the fifth at which time the sulfided catalyst contains a maximum of about 0.01 percent sulfur.

15. The process of claim 1 wherein sulfur is added to the catalysts during about the first five catalyst regeneration/reactivation sequences, the sulfur added to the catalyst being progressively reduced between the first catalyst regeneration/reactivation sequence and abut the fifth at which time the sulfided catalyst contains a maximum of about 0.01 percent sulfur, and thereafter sulfur is directly added only to a tail reactor, or to the swing reactor when it occupies the position of a tail reactor which has been removed for regeneration and reactivation of the catalyst contained therein.

16. The process of claim 1 wherein the catalysts are platinum catalysts promoted with a hydrogenation-dehydrogenation component, or components, which increase the rate of hydrogenolysis as contrasted with an unpromoted platinum catalyst.

17. The process of claim 16 wherein the platinum catalyst is promoted with rhenium.

18. In a process for reforming, with hydrogen, a naphtha in a cyclic reforming unit which contains a plurality of catalyst-containing on-stream reactors connected in series, and a catalyst-containing swing reactor which, due to an arrangement of process piping and values comprising headers, can be substituted for any one of the on-stream reactors while the latter is off-stream from regeneration and reactivation of the catalyst, the catalyst is a platinum catalyst promoted with a hydrogenation-dehydrogenation component, or components, which increase the rate of hydrogenolysis as contrasted with an unpromoted platinum catalyst, the hydrogen and naphtha feed flows from one reactor of the series to another to contact the catalyst contained therein at reforming conditions, the improvement comprising adding a maximum of about 0.01 percent sulfur to the catalyst of a reactor after about the fifth sequence of regeneration and reactivation of the freshly prepared catalyst, returning said reactor to the position occupied by the last reactor of the series and placing said reactor on-stream, drying the off gas from said reactor to remove water so that the moisture level of the gas recycled through the unit contains below about 50 ppm water.

19. The process of claim 18 wherein the platinum catalyst is promoted with rhenium.

20. The process of claim 18 wherein a maximum of about 0.001 percent to about 0.005 percent sulfur is added to the catalyst after about the fifth sequence of regeneration and reactivation.

21. The process of claim 18 wherein the moisture level of the gas recycled through the unit contains below about 20 ppm water.

22. The process of claim 18 wherein sulfur is added to the catalysts during about the first five catalyst regeneration/reactivation sequences, the sulfur added to the catalyst being progressively reduced between the first catalyst regeneration/reactivation sequence and about the fifth at which time the sulfided catalyst contains an equilibrium amount of sulfur, and thereafter a maximum of about 0.005 percent sulfur is directly added only to a tail reactor, or to the swing reactor when is occupies the position of a tail reactor which has been removed for regeneration and reactivation of the catalyst contained therein.

23. The process of claim 22 wherein a series of four on-stream reactors are employed, identified for convenience, as A, B, C, D, respectively, and the swing reactor is identified, for convenience as S, the improvement wherein after about the fifth regeneration/reactivation sequence the catalysts of Reactors A, B and C are no longer directly sulfided, but only the catalyst of Reactor D, and Reactor S when substituted for Reactor D, is directly sulfided.

* * * * *